US010619401B2

(12) United States Patent
Krause

(10) Patent No.: US 10,619,401 B2
(45) Date of Patent: Apr. 14, 2020

(54) WINDOW OPENING INSULATION SYSTEM

(71) Applicant: Advanced Architectural Products, LLC, Allegan, MI (US)

(72) Inventor: G. Matt Krause, Allegan, MI (US)

(73) Assignee: Advanced Architectural Products, LLC, Allegan, MI (US)

( * ) Notice: Subject to any disclaimer, the term of this patent is extended or adjusted under 35 U.S.C. 154(b) by 0 days.

(21) Appl. No.: 16/190,306

(22) Filed: Nov. 14, 2018

(65) Prior Publication Data

US 2019/0145154 A1 May 16, 2019

Related U.S. Application Data

(60) Provisional application No. 62/586,042, filed on Nov. 14, 2017.

(51) Int. Cl.

| | |
|---|---|
| ***E06B 3/263*** | (2006.01) |
| ***E06B 1/56*** | (2006.01) |
| ***E06B 1/62*** | (2006.01) |
| ***E06B 1/02*** | (2006.01) |

(52) U.S. Cl.

CPC ..... *E06B 3/26307* (2013.01); *E06B 1/02* (2013.01); *E06B 1/56* (2013.01); *E06B 1/62* (2013.01); *E06B 3/2632* (2013.01); *E06B 3/26336* (2013.01); *E06B 3/26347* (2013.01); *E06B 2001/628* (2013.01); *E06B 2003/26389* (2013.01)

(58) Field of Classification Search

CPC combination set(s) only.
See application file for complete search history.

(56) References Cited

U.S. PATENT DOCUMENTS

| | | | | |
|---|---|---|---|---|
| 4,433,517 | A * | 2/1984 | Moore, Jr. | E06B 3/221 52/204.55 |
| 6,604,323 | B1 * | 8/2003 | Joo | E06B 3/26341 49/163 |
| 9,739,084 | B2 * | 8/2017 | Brooks, III | E06B 1/02 |
| 2010/0058683 | A1 * | 3/2010 | Bushberger | E06B 1/705 52/209 |
| 2013/0000232 | A1 * | 1/2013 | Weiss | B32B 17/10055 52/204.6 |
| 2014/0366455 | A1 * | 12/2014 | Helton | E06B 7/16 49/483.1 |
| 2015/0354208 | A1 * | 12/2015 | Brooks, III | E06B 1/02 52/215 |

* cited by examiner

*Primary Examiner* — Joshua K Ihezie
(74) *Attorney, Agent, or Firm* — Jovan N. Jovanovic; The Watson IP Group, PLC

(57) ABSTRACT

The insulation system includes opening wall, substrate wall, thermal closure, insulation and exterior trim. A window structure can be coupled to cover opening, while other structures are contemplated. Depending on the configuration, tape strips and/or seals such as caulk seals may be employed as needed to seal the structure.

16 Claims, 4 Drawing Sheets

WINDOW OPENING INSULATION SYSTEM

CROSS-REFERENCE TO RELATED APPLICATION

This application claims priority from U.S. Pat. App. Ser. No. 62/586,042 filed Nov. 14, 2017, entitled "Window Opening Insulation System", the entire specification of which is hereby incorporated by reference in its entirety.

This application does not claim priority from, but is related to, U.S. patent application Ser. No. 15/642,366 entitled Internal Composition of a Bracket Member for Insulation, filed Jul. 6, 2017, as well as U.S. Pat. No. 8,826,620 entitled Polymer-Based Bracket System for Metal Panels, as well as U.S. Pat. No. 9,151,052 entitled Insulation System for Buildings, the entire disclosure of each of the foregoing, as well as to any patent applications incorporated therein is hereby incorporated by reference in its entirety.

BACKGROUND OF THE DISCLOSURE

1. Field of the Disclosure

The disclosure relates in general to building structures, and more particularly, to a building structure having a window opening insulation system.

2. Background Art

Currently, commercial cladding and insulation systems around building openings (which hereinafter collectively comprises a window opening, regardless of whether the opening is for a door, a window or another structure), typically includes a metal angle around the perimeter of the window opening in the framing. While the metal angle provides a surface for the exterior trim to attach to a surface for the AWB behind to seal the same, problematically, the metal angle provides a metallic thermal short circuit path from the outside to the inside.

Some solutions have relied upon the use of wood framing. Among other limitations, wood requires the use of metal fasteners, which may define a thermal short circuit; wood is porous, wood is flammable, wood is a volumetrically thermally conductive material; wood can emit resin or chemicals; wood is not hydrostatically stable; wood is not dimensionally stable; wood tends to be relatively expensive; wood can promote mold; and in these applications, wood can be relatively thick. Other problems exist with other solutions.

SUMMARY OF THE DISCLOSURE

The disclosure is directed to a window opening insulation system comprising an opening wall, a substrate wall, a thermal closure, insulation and exterior trim. The system is deployed about an opening, for a window or the like, and is not limited to use with a window, solely.

In some configurations, the exterior trim can be removed, as can other structures. Additionally, tape strips and/or seals (such as caulk or the like) can be employed to further provide the necessary barrier properties.

In other configurations, the thermal closure may be provided solely and may be utilized in the manner described.

In some configurations, the thermal closure may be planar. In other configurations, the thermal closure may have two legs that define planes that are right angles relative to each other.

In another aspect of the disclosure, the disclosure is directed to a window opening insulation system comprising an opening wall, a substrate wall, a thermal closure and insulation. The opening wall has an outer surface. The substrate wall has an inner surface overlying the outer surface of the opening wall, and an outer surface opposite thereto. The thermal closure comprises a polymer having a wall leg and an opening leg one of oblique and perpendicular thereto. The wall leg has an inner surface overlying the outer surface of the substrate wall. The opening leg is overlyingly associated with a window structure;

The insulation has an outer surface, an inner surface and an opening surface spanning between the outer surface and the inner surface. The inner surface of the insulation overlying the outer surface of the substrate wall and the outer surface of the wall leg of the thermal closure. The inner surface overlies the inner surface of the opening leg.

In some configurations, the system further includes an exterior trim having an overlying wall and an opening wall one of oblique and perpendicular to the overlying wall. The overlying wall is positioned so as to sandwich the insulation together with the wall leg of the thermal closure. The opening wall overlies the outer surface of the opening leg of the thermal closure.

In some such configurations, the outer surface of the opening leg and the outer surface of the opening wall are substantially coplanar.

In some such configurations, the insulation is selected from the group consisting of: mineral wool, blown insulation, fiberglass insulation.

In some such configurations, the opening wall comprises wood studs, metal studs and/or composite studs.

In some such configurations, the substrate wall comprises one of the group consisting of: OSB, plywood or wood, fiber based or synthetic based substrates.

In some configurations, the thermal closure is formed from a pultruded polymer based member reinforced with one of fibers and/or a fiber fabric.

In some configurations, the system further comprises a tape extending over the outer surface of the wall leg of the thermal closure and the outer surface of the substrate wall to seal the same.

In some configurations, the system includes a second tape extending overt the outer surface of the insulation and the outer surface of the opening leg of the thermal closure to seal the same.

In some configurations, the wall leg and the opening leg of the thermal closure are substantially perpendicular.

In another aspect of the disclosure, the disclosure is directed to a wall opening insulation system comprising an opening wall, a substrate wall, a thermal closure and insulation. The opening has an outer wall. The substrate wall has an inner surface overlying the outer surface of the opening wall, and an outer surface opposite thereto. The thermal closure comprises a polymer defining an opening leg having a substantially planar configuration, and having an inner surface and an outer surface opposite the inner surface. The opening leg overlying the outer surface of the opening wall and extending outwardly beyond the substrate wall. The insulation has an outer surface, an inner surface and an opening surface spanning between the outer surface and the inner surface. The inner surface of the insulation overlying the outer surface of the substrate wall, with the inner surface overlying the inner surface of the opening leg.

In some configurations, the opening leg terminates at the outer surface of the insulation.

In some configurations, the system further includes an exterior trim having an overlying wall and an opening wall one of oblique and perpendicular to the overlying wall. The overlying wall is positioned to overly the outer surface of the insulation, with the opening wall overlying the outer surface of the opening leg of the thermal closure.

In some such configurations, the insulation is selected from the group consisting of: mineral wool, blown insulation, fiberglass insulation.

In some such configurations, the opening wall comprises wood studs, metal studs and/or composite studs.

In some such configurations, the substrate wall comprises one of the group consisting of: OSB, plywood or wood, fiber based or synthetic based substrates.

In some configurations, the thermal closure is formed from a pultruded polymer based member reinforced with one of fibers and/or a fiber fabric.

In some configurations, the system further includes a tape extending overt the outer surface of the insulation and the outer surface of the opening leg of the thermal closure to seal the same.

BRIEF DESCRIPTION OF THE DRAWINGS

The disclosure will now be described with reference to the drawings wherein.

DETAILED DESCRIPTION OF THE DISCLOSURE

Figure 1:
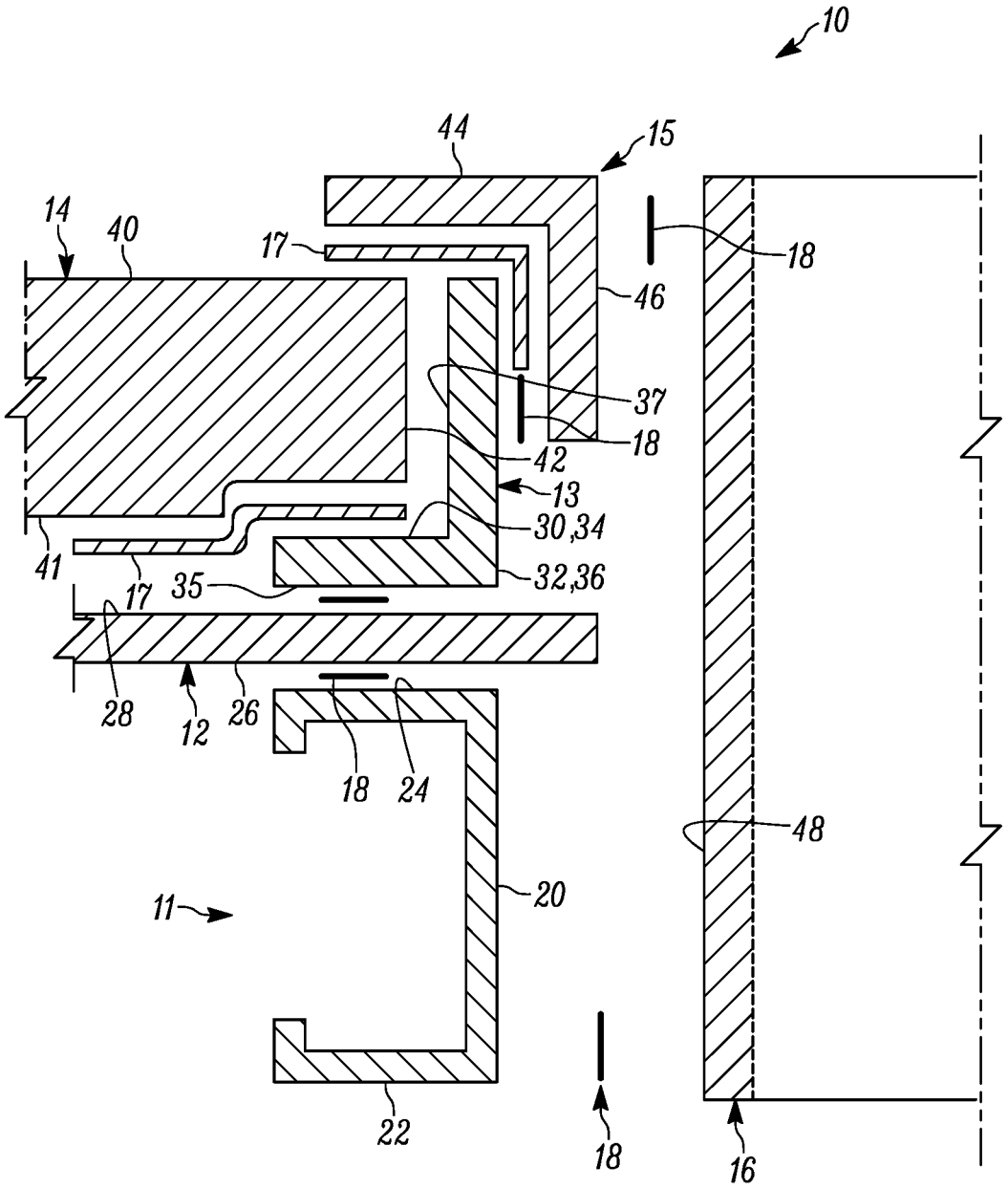
FIG. 1 of the drawings is a cross-sectional view of a window opening insulation system of the present disclosure.

While this disclosure is susceptible of embodiment in many different forms, there is shown in the drawings and described herein in detail a specific embodiment(s) with the understanding that the present disclosure is to be considered as an exemplification and is not intended to be limited to the embodiment(s) illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, a configuration of the window opening insulation system is shown generally at 10. The insulation system includes opening wall 11, substrate wall 12, thermal closure 13, insulation 14 and exterior trim 15. A window structure 16 can be coupled to cover opening 100 (FIG. 3), while other structures are contemplated. Depending on the configuration, tape strips, such as tape 17 and/or seals such as caulk seals 18 may be employed as needed to seal the structure.

With continuing reference to FIG. 1, the opening wall 11 includes opening surface 20, inner surface 22 and outer surface 24. In the configuration shown in FIGS. 3 and 5, the opening 100 is substantially rectangular or square, and it will be understood that the structure shown here may be utilized to surround the entirety of the opening. The opening wall may comprise studs that may be made from wood, metal, or composites.

The substrate wall 12 includes inner surface 26 and outer surface 28. The substrate wall comprises any number of different materials, including but not limited to, OSB, plywood or other wood, fiber based or synthetic materials. The disclosure is not limited to any particular type of material for the substrate wall.

Figure 4:
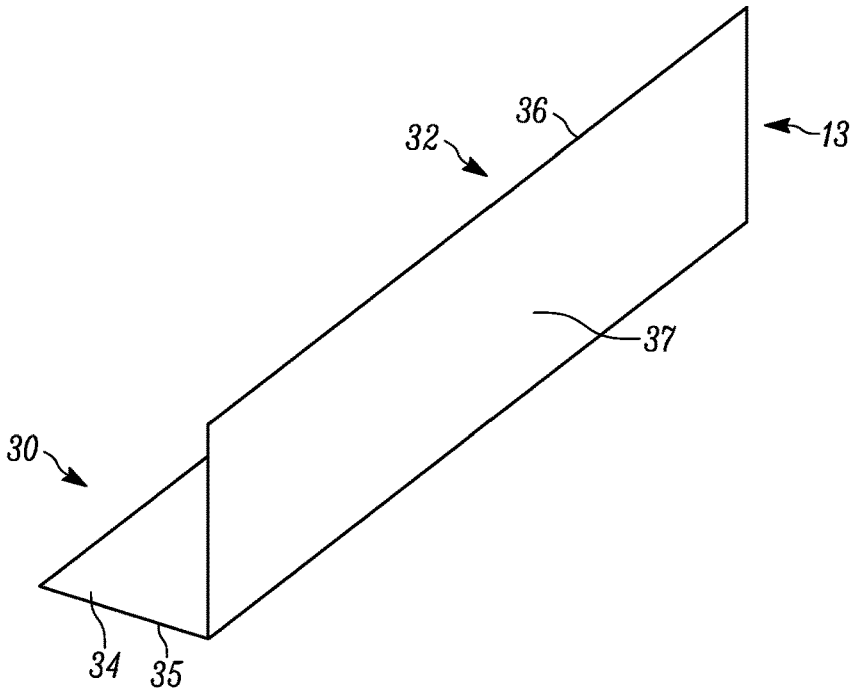
FIG. 4 of the drawings is a perspective view of a section of thermal closure.

The thermal closure 13 is shown in FIG. 1, and in FIG. 4 in more detail, as comprising wall leg 30 and opening leg 32. The wall leg includes outer surface 34 and inner surface 35. The opening leg 32 comprises outer surface 36 and inner surface 37. The wall leg and the opening leg are disposed so as to be substantially perpendicular to each other (i.e., +/−15° and preferably less).

The thermal closure 13 shown in FIG. 1 comprises a pultruded polymer based member that is reinforced with one of fibers and/or a fiber fabric. In the configuration shown, a filler, preferably comprising, ATH is also utilized (or a combination of ATH and another filler, such as calcium carbonate, for example. Some such constructions are disclosed in the above-incorporated references in the cross-reference to related application. Such disclosures disclose the particular material, configurations, and structures associated with the thermal closure, and the materials associated therewith. In the configuration shown, the pultruded member has a thickness of approximately 0.1 inches, or the like. While there is no specific thickness, it will be understood that the configuration has a R value of 19, for example. Of course, other variations are contemplated for use.

Figure 3:
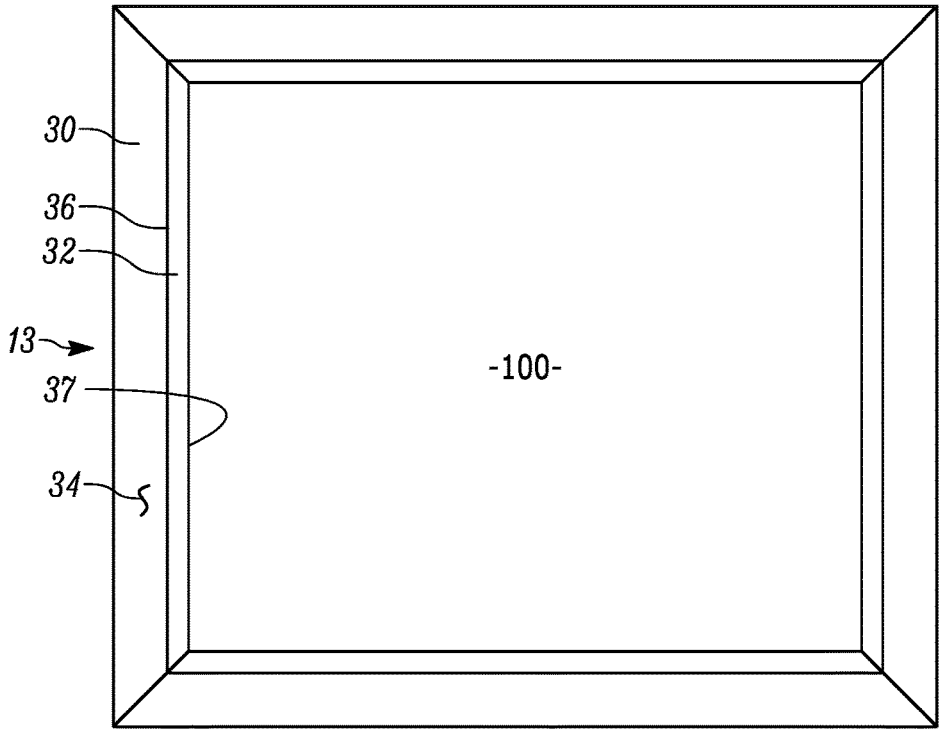
FIG. 3 of the drawings is a front elevational view of a window opening, having a configuration of the thermal closure extending therearound.

One structure positioned about opening 100 is disclosed in FIG. 3, with the thermal closure 13 shown in FIG. 4. In another structure, shown around the opening in FIG. 5 and in isolation as thermal closure 133 in FIG. 6, respectively. In these Figures, the rest of the system is removed for pictorial clarity. In such a configuration, the member comprises a substantially planar sheet, that can be made from the same material as the thermal closure 13, described above.

The insulation 14 is shown in FIG. 1 as comprising a sheet insulation, such as a polymer (urethane, for example) foam sheet. Of course, other constructions are likewise contemplated, including but not limited to mineral wool, blown insulation, fiberglass insulation, among others. In the configuration shown, the insulation includes outer surface 40, inner surface 41, and opening surface 42. Typically, the insulation comprises larger sheets that may be a predetermined width, thickness and length. These are interfaced with girts (of the type disclosed in the cross-reference to related applications set forth above). That is, at predetermined spacings, a girt or the like may interface with the thermal closure, as will be described below.

The exterior trim 15 is shown in FIG. 1 as comprising overlying wall 44 and opening wall 46. The overlying wall and the opening wall are disposed at generally right angles relative to each other. Preferably, the angle comprises a metal member, or a polymer based member.

The assembly, in one configuration, is shown in FIG. 1 as comprising an existing building having an opening wall 11 that forms part of a building structure (i.e., the studs thereof). The opening wall defines an opening 100 (FIG. 3). The substrate wall is placed over the opening wall and coupled thereto. In the configuration shown, the inner surface 26 of the substrate wall extends over the outer surface of the opening wall.

Next, the thermal closure can be positioned over the substrate wall 12. The thermal wall is positioned such that the wall leg 30 overlies the outer surface 28 of the substrate wall. The opening leg 32 is aligned with the opening surface 20 of the opening wall 11.

Insulation 14 can be placed over the outer surface 28 of the substrate wall 12 and the wall leg of the thermal closure. The insulation can then be slid into abutment with the inner surface 37 of the opening leg 32 of the thermal closure 13.

Finally, the exterior trim can be placed over the interface between the opening leg of the thermal closure and the outer surface 40 of the insulation. In such a configuration, the opening wall 46 extends along the opening leg of the thermal closure.

Tape strips, such as tape strip 17 can be employed as desired at various seams between the different structures. In other configurations, the tape strips can be omitted, or may be positioned in orientations other than those that are disclosed in FIG. 1. It will further be understood that the seals, such as seals 18 can be positioned at various regions as is shown in FIG. 1. Of course, seals may be fully omitted or may be disposed at various locations in and around the structure.

Figure 2:
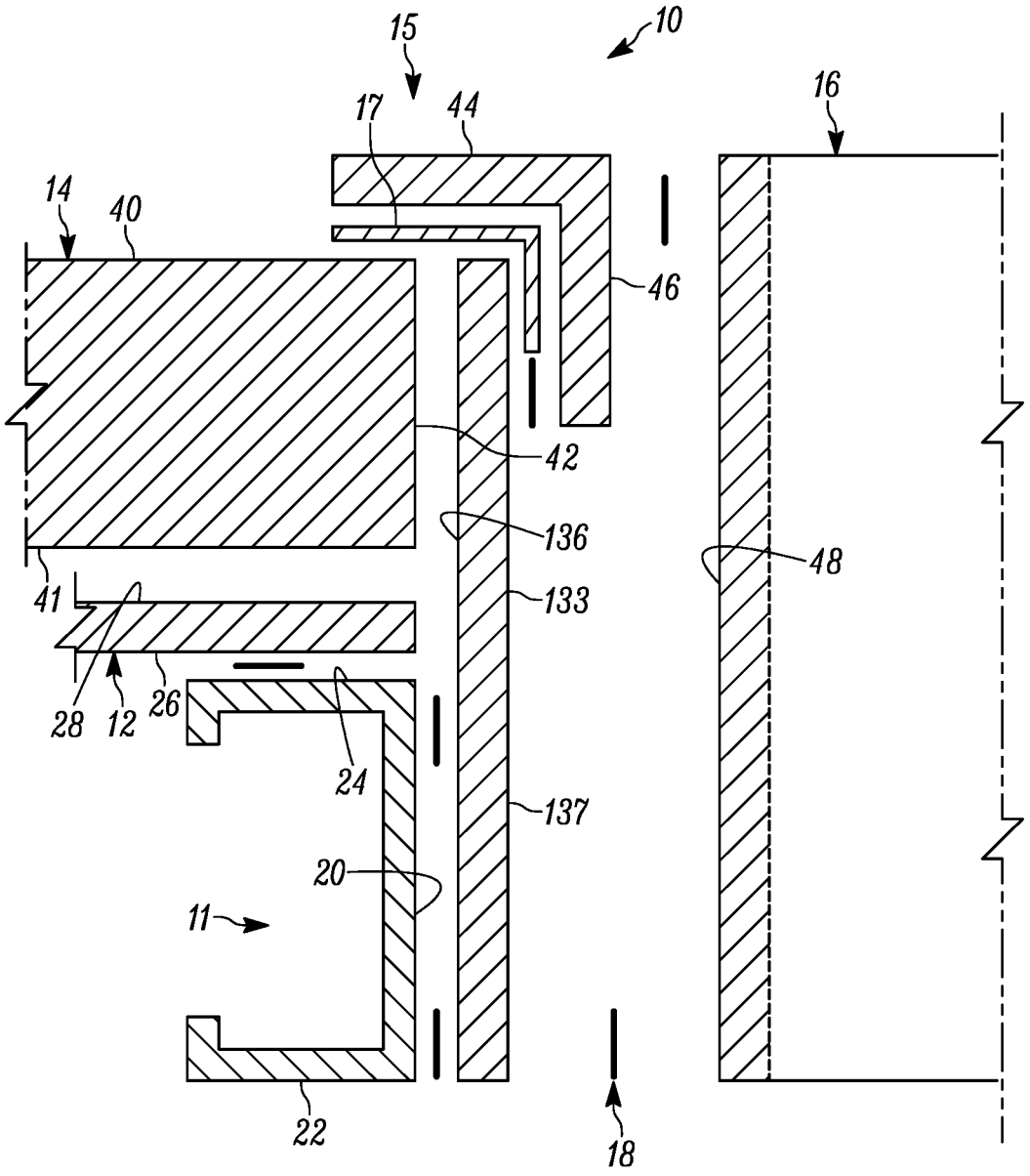
FIG. 2 of the drawings is a cross-sectional view of another window opening insulation system of the present disclosure.
Figure 5:
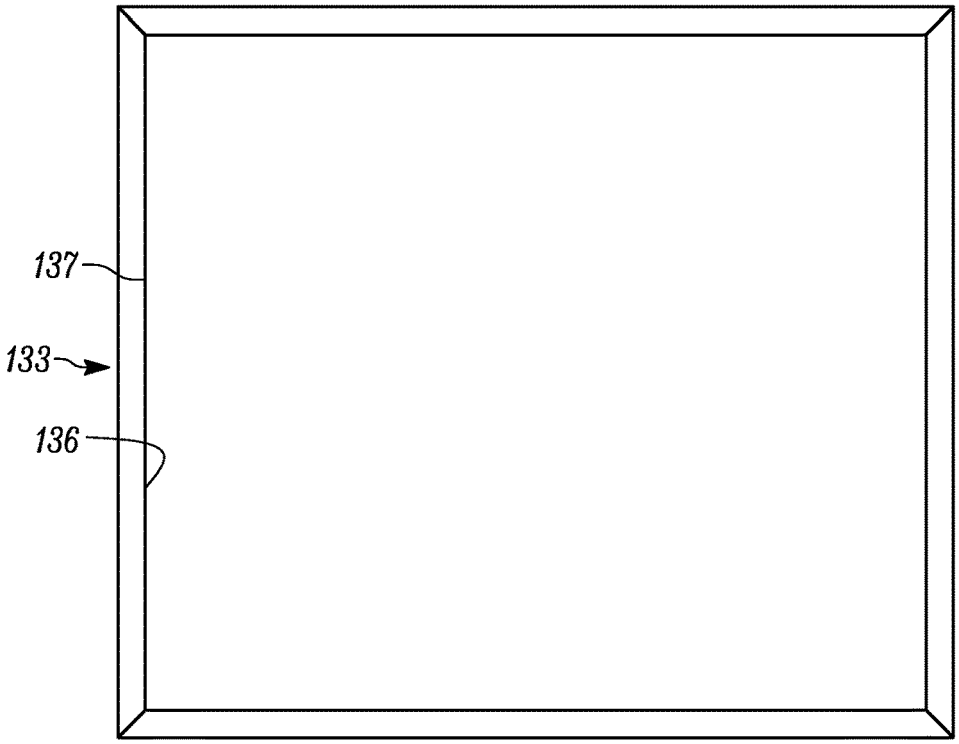
FIG. 5 of the drawings is a front elevational view of a window opening, having a second configuration of the thermal closure extending therearound.
Figure 6:
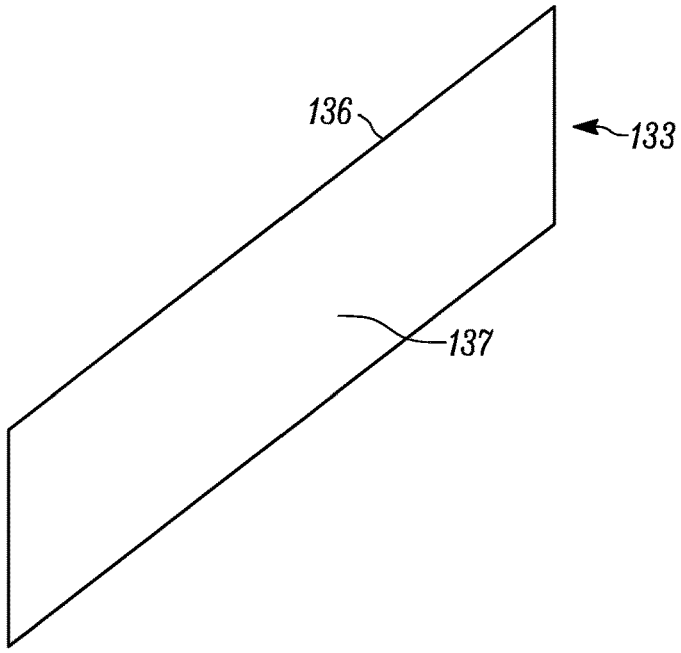
FIG. 6 of the drawings is a perspective view of a section of thermal closure.

With reference to FIG. 2, instead of a thermal closure that is angled, with wall leg and opening leg being perpendicular to each other, the thermal closure 133 is substantially planar and includes outer surface 136 and inner surface 137. In such a configuration, the thermal closure extends along the length of the insulation, the substrate wall and the opening wall. Such a structure wherein only the thermal closure is coupled to the opening is shown in FIG. 5 with the thermal closure 133 in FIG. 6.

In either case, the window structure 16 can be inserted into the opening 100.

The foregoing description merely explains and illustrates the disclosure and the disclosure is not limited thereto except insofar as the appended claims are so limited, as those skilled in the art who have the disclosure before them will be able to make modifications without departing from the scope of the disclosure.

What is claimed is:

1. A window opening insulation system comprising:

an opening wall having an outer surface;

a substrate wall having an inner surface overlying the outer surface of the opening wall, and an outer surface opposite thereto;

a thermal closure comprising a polymer having a wall leg and an opening leg one of oblique and perpendicular thereto, the wall leg having an inner surface overlying the outer surface of the substrate wall, with the opening leg overlyingly associated with a window structure;

insulation having an outer surface, an inner surface and an opening surface spanning between the outer surface and the inner surface, the inner surface of the insulation positioned above the outer surface of the substrate wall and the outer surface of the wall leg of the thermal closure, with the inner surface of the insulation overlying the inner surface of the opening leg; and an exterior trim having an overlying wall and an opening wall one of oblique and perpendicular to the overlying wall, the overlying wall being positioned so as to sandwich the insulation together with the wall leg of the thermal closure, with the opening wall overlying the outer surface of the opening leg of the thermal closure.

2. The window opening insulation system of claim 1 wherein the outer surface of the opening leg and the outer surface of the opening wall are substantially coplanar.

3. The window opening insulation system of claim 2 wherein the insulation is selected from the group consisting of: mineral wool, blown insulation, fiberglass insulation.

4. The window opening insulation system of claim 2 wherein the opening wall comprises wood studs, metal studs and/or composite studs.

5. The window opening insulation system of claim 2 wherein the substrate wall comprises one of the group consisting of: OSB, plywood or wood, fiber based or synthetic based substrates.

6. The window opening insulation system of claim 2 wherein the thermal closure is formed from a pultruded polymer based member reinforced with one of fibers and/or a fiber fabric.

7. The window opening insulation system of claim 1 further comprising a tape extending over the outer surface of the wall leg of the thermal closure and the outer surface of the substrate wall.

8. The window opening insulation system of claim 7 further comprising a second tape extending overt the outer surface of the insulation and the outer surface of the opening leg of the thermal closure.

9. The window opening insulation system of claim 1 wherein the wall leg and the opening leg of the thermal closure are substantially perpendicular.

10. A window opening insulation system comprising:

an opening wall having an outer surface;

a substrate wall having an inner surface overlying the outer surface of the opening wall, and an outer surface opposite thereto;

a thermal closure comprising a polymer defining an opening leg having a substantially planar configuration, and having an inner surface and an outer surface opposite the inner surface, the opening leg overlying the outer surface of the opening wall and extending outwardly beyond the substrate wall;

insulation having an outer surface, an inner surface and an opening surface spanning between the outer surface and the inner surface, the inner surface of the insulation overlying the outer surface of the substrate wall, with the inner surface of the insulation overlying the inner surface of the opening leg; and an exterior trim having an overlying wall and an opening wall one of oblique and perpendicular to the overlying wall, the overlying wall being positioned to overly the outer surface of the insulation, with the opening wall overlying the outer surface of the opening leg of the thermal closure.

11. The window opening insulation system of claim 10 wherein the opening leg terminates at the outer surface of the insulation.

12. The window opening insulation system of claim 11 wherein the insulation is selected from the group consisting of: mineral wool, blown insulation, fiberglass insulation.

13. The window opening insulation system of claim 11 wherein the opening wall comprises wood studs, metal studs and/or composite studs.

14. The window opening insulation system of claim 11 wherein the substrate wall comprises one of the group consisting of: OSB, plywood or wood, fiber based or synthetic based substrates.

15. The window opening insulation system of claim 11 wherein the thermal closure is formed from a pultruded polymer based member reinforced with one of fibers and/or a fiber fabric.

16. The window opening insulation system of claim 10 further comprising a tape extending over the outer surface of the insulation and the outer surface of the opening leg of the thermal closure.

* * * * *